United States Patent [19]

Hung

[11] 4,331,192

[45] May 25, 1982

[54] HORIZONTAL HYDRAULIC WOOD SPLITTER

[76] Inventor: Michael Hung, 6th Fl., No. 65, Nanking E. Rd., Sec. 3, Taipei, Taiwan

[21] Appl. No.: 89,964

[22] Filed: Oct. 31, 1979

[51] Int. Cl.[3] ..... B27L 7/00

[52] U.S. Cl. ..... 144/193 A

[58] Field of Search ..... 144/193 R, 193 A; 254/93 H

[56] References Cited

U.S. PATENT DOCUMENTS

| | | | |
|---|---|---|---|
| 3,285,304 | 11/1966 | Fuller | 144/193 A |
| 3,356,115 | 12/1967 | Cole | 144/193 R |
| 3,779,295 | 12/1973 | Balsbaugh | 144/193 A |
| 4,141,396 | 2/1979 | McCollister | 144/193 A |
| 4,153,088 | 5/1979 | King et al. | 144/193 A |
| 4,157,105 | 6/1979 | Gansley | 144/193 A |

*Primary Examiner*—W. D. Bray

[57] ABSTRACT

A mechanism for splitting wood, characterized in a length-adjustable bed, at one end of which is installed a fixed axe block, and at the other end a hydraulic pump unit or a jack of a type on the present market may be installed. By operating the pump unit, the wood accommodated on the bed will be pushed toward the axe and split. This mechanism is not only labor-saving and safe, but is also suitable for any size length of wood. In addition, the pump unit can be substituted with a jack for practical operation.

5 Claims, 5 Drawing Figures

HORIZONTAL HYDRAULIC WOOD SPLITTER

BACKGROUND OF THE INVENTION

In this society wood burning has been used for cooking, lighting and heating. At the present time many families have a fireplace installed in the house to burn wood in the winter for light and heat. Naturally, the wood must be split into pieces for easy burning. However, large wood is not easily split with an axe by manpower. Furthermore, many unexpected accidents may occur and cause injury to the person who tries to split large wood with an axe, because of the lack of safety. In order to overcome this deficiency the present invention provides a mechanism which is not only labor-saving, but also able to split large wood safely.

SUMMARY OF THE INVENTION

The present invention relates to a mechanism for splitting wood which comprises a length-adjustable bed, at one end of which is installed a fixed axe block and at the other end a hydraulic pump unit, with the wood being accommodated therebetween. By operating the pump unit, the wood will be pushed toward the axe and the mechanism can easily and safely split the wood. Since the bed of this invention is length-adjustable, it is suitable for any size length of wood. Moreover, the bed is formed by two square steel pipes which can be retracted when not in use, and the axe block and the hydraulic pump unit block, separately installed at both ends of the bed, and the rollers, are also removable. It is convenient for storage, package and transportation, and can be operated easily by both adults and children. Therefore, it is suitable for use in all families.

DESCRIPTION OF THE PREFERRED EMBODIMENTS

Figure 2:
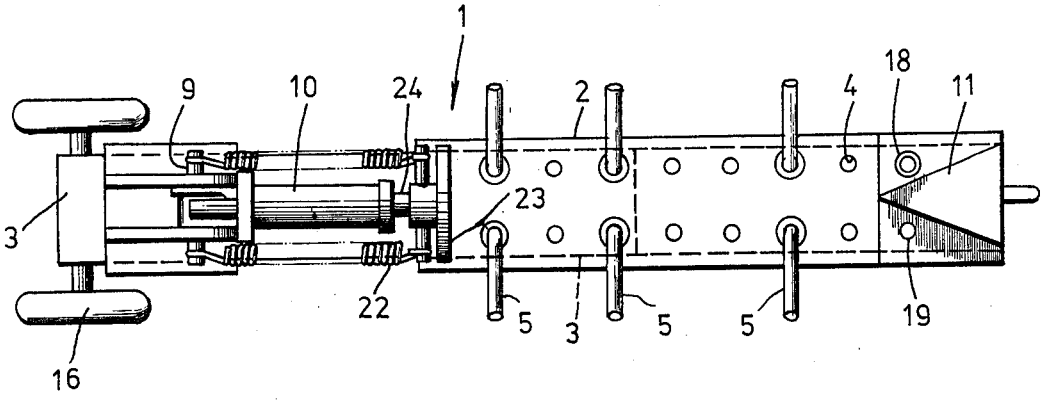
FIG. 2 is a top view, showing the shape of axe block and the installation method of hydraulic pump unit.
Figure 1:
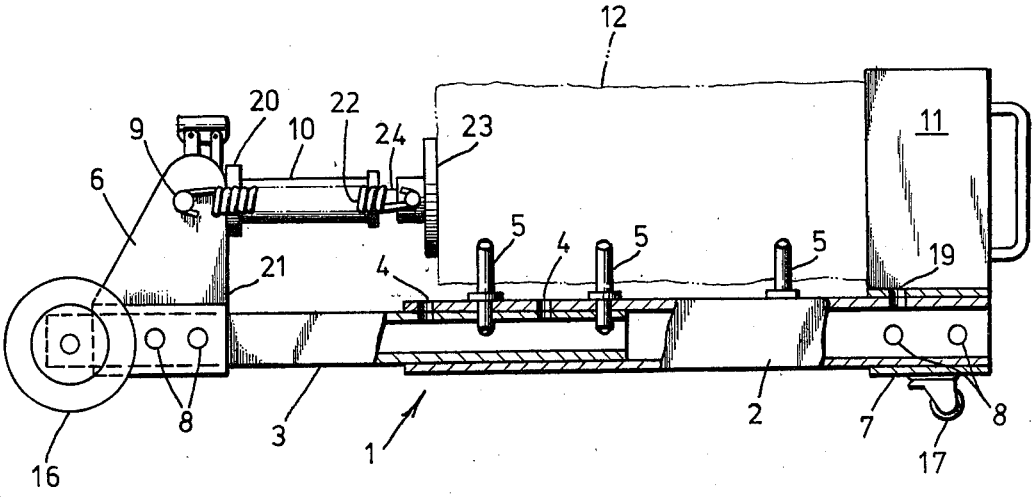
FIG. 1 is a front view of invention, showing the corresponding positions and shapes of its primary portions.

As shown in FIG. 1, bed 1 is composed of one section of larger square steel pipe 2 and another section of smaller square steel pipe 3 which can be socketed into the said pipe 2. Along both sides of pipe 2 and 3, there are two lines of holes 4 allowing fixing pins 5 to adjust and fix the length of bed 1 (as shown in FIG. 2) in order to adjust to the length of wood.

At both ends of bed 1 are separately installed a hydraulic pump unit block 6 and an axe block 7. They can be fixed to bed 1 with pins 8. The position of axe block 7 can also be adjusted and fixed by putting an inserting pin 18 into the hole 19 of axe block 7 and the hole 4 of larger square steel pipe 2. In other words, together with the length adjustment of bed 1, this mechanism possesses a dual adjustment of the distance between axe 11 and the pump or hydraulic jack unit 10 to accommodate any size length of wood.

The pins 8, the pump unit block 6 and the axe block 7 can be disconnected when storing. On the said pump unit block 6, there is a pivot 9 on which the pump or hydraulic jack unit 10 is fixed. There is also installed an axe 11 for splitting wood on the said axe block 7. The wood 12, which is accommodated therebetween, can be split when operating pump unit 10 to push the wood 12 toward the axe 11. Further, in order to automatically retract the push board 23 when the wood 12 is split and the hydraulic pump unit 10 is released, two return springs 22 are installed on both sides of the pump unit 10, one end of the return springs 22 is connected to the pivot 9 of the pump unit block 6 and the other ends to the push board 23 which is in front of the plunger 24 of the pump unit 10.

Figure 4:
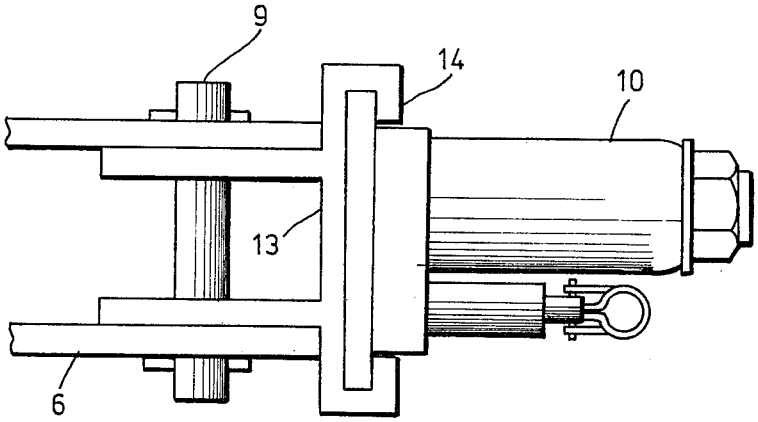
FIG. 4 is a top view, showing the conditions of installing other type of jacks.
Figure 5:
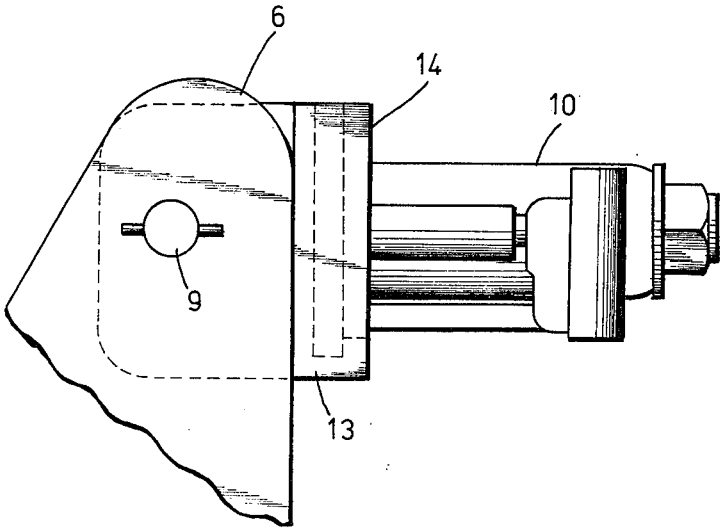
FIG. 5 is a front view, showing what to be showed in FIG. 4.

FIG. 4 shows the installation of the pump unit block 6 on the supporting board 13. The supporting board 13 is fixed on the pump unit block 6 with the pivot 9, and on which there is a clamp device 14 designed to fix a jack of any type.

Figure 3:
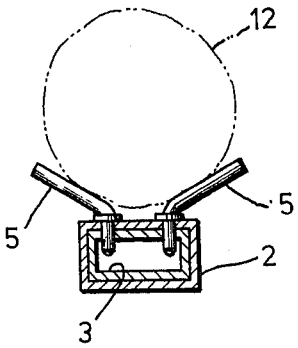
FIG. 3 is a side view, showing the connecting and fixing conditions of two-section bed.

As shown in FIG. 3, the upper ends of the fixing pins 5 are bent outward to prevent the wood 12 from sliding away.

As shown in FIG. 1, two rollers 16 are installed on both sides of the pump unit block 6, and an universal roller 17 is installed under the axe block 7. The rollers 16 and 17 can be disconnected, then, this mechanism is convenient for storage and transportation.

Further, a supporting block 20 can be installed on the right edge 21 of the pump unit block 6 to keep the pump unit 10 horizontal with bed 1 for easy operation.

What is claimed is:

1. A mechanism for splitting wood by the power of a jack unit, which comprises:

a bed composed of two pipes comprising a smaller pipe and a larger pipe, said smaller pipe socketed into said larger pipe for length adjustment, said two pipes provided with holes and including fixing pins selectively insertable within said holes to adjust the length of said bed, upper ends of said fixing pins defining wood receiving means and being bent outwardly to prevent the wood disposed thereon from sliding away;

a pump block having a jack, bolts for removably connecting said pump block with an end of said smaller pipe in a selected fixed position;

an axe block, bolts for removably connecting said axe block with an end of said larger pipe and an axe on said axe block for splitting wood whereby extension of said jack forces the wood against said axe.

2. The mechanism as claimed in claim 1 including a clamp device on said pump block for mounting a jack of any type.

3. The mechanism as claimed in claim 1 wherein said bed is provided with locking holes and wherein said axe block is provided with locking holes which are matched with the corresponding holes on said bed for inserting said fixing pins to adjust and fix each to the other.

4. The device as claimed in claim 1 wherein said jack comprises a hydraulic pump having a plunger and said pump block has a vertical groove along a face nearest said axe block for slidable reception therein of said pump, and return springs extending between said pump block and a push board attached to said plunger of said hydraulic pump remote from said pump block to retract said pump plunger.

5. The device as claimed in claim 4 including removable wheels on said bed for transporting said wood splitting mechanism.

* * * * *